United States Patent [19]

Wildfeuer

[11] 4,334,412

[45] Jun. 15, 1982

[54] COOLING SYSTEM

[76] Inventor: Robert Wildfeuer, 85 Floral Dr. W., Plainview, N.Y. 11803

[21] Appl. No.: 94,742

[22] Filed: Nov. 15, 1979

[51] Int. Cl.[3] ..... F25D 17/00

[52] U.S. Cl. ..... 62/333; 62/434; 165/104.17; 165/104.18

[58] Field of Search ..... 62/332, 430, 434, 333; 165/104 M, 104 S

[56] References Cited

U.S. PATENT DOCUMENTS 3,869,870 3/1975 Kuehner ..... 165/104 M 3,906,742 9/1975 Newton ..... 62/332

*Primary Examiner*—Ronald C. Capossela

*Attorney, Agent, or Firm*—Evelyn M. Sommer

[57] ABSTRACT

A cooling system particularly suitable for use in the air-conditioning of buildings is described. The system includes:

(a) A cooling zone containing a conduit for cooling fluid, the conduit encountering the heat load, means in the conduit for propelling the fluid through the conduit, and cooling fluid in the conduit;

(b) A refrigeration zone containing a closed refrigeration circuit for refrigerant, chiller means in the circuit for extracting energy from the refrigerant, means for circulating refrigerant in the circuit and refrigerant in the circuit; and (c) Collection means connected to the refrigeration zone for removing energy extracted by the chiller.

The cooling and refrigeration zones are connectable through a heat exchanger for transfer of energy between the fluid and the refrigerant and the refrigerant comprises a slurry of ice and water which may be partly stored in a reservoir constituting part of the refrigeration zone. In this system, a reserve cooling capacity can be stored in the reservoir for use during cyclic requirements therefor.

10 Claims, 1 Drawing Figure

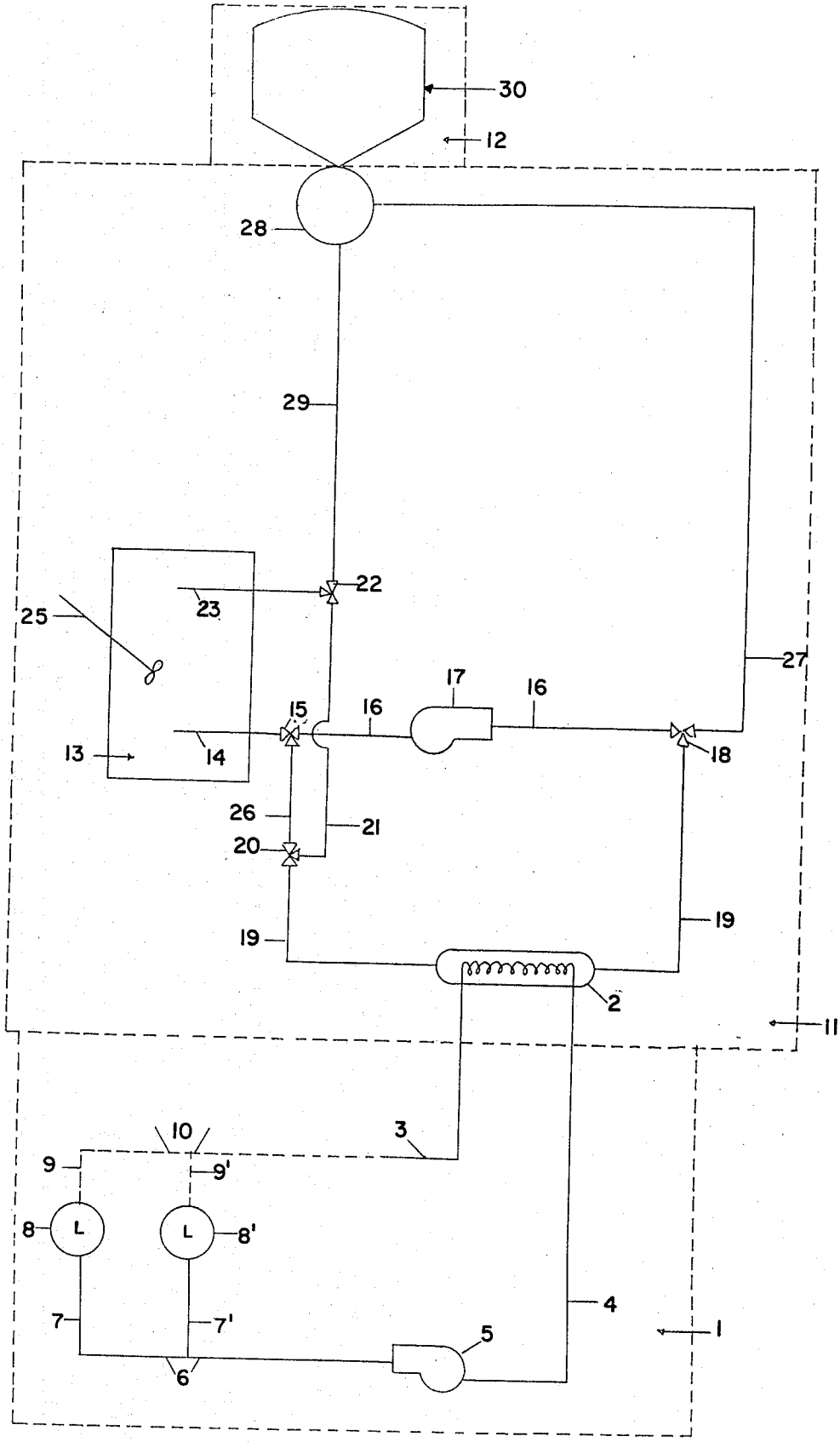
30
12
28
29
22
23
25
27
17
16
15
16
18
13
14
26
21
20
19
19
2
11
10
3
9
9'
8
L
L
8'
4
7
7'
5
1
6

COOLING SYSTEM

BACKGROUND AND SUMMARY OF THE INVENTION

This invention relates to a system for the cooling of structures or other enclosures. It is especially suitable for situations where cooling requirements, or the "load", may vary substantially. It is therefore particularly useful for the air-conditioning of building structures.

The minimization of requirements for operating cooling systems of all kinds has become increasingly important with the recent rise in related costs. One means for doing so would be to overcome the drawbacks of cycles inherent in the operation of these systems. Unfortunately, these means are not readily available.

There are two main cycles that have contributed to these costs. First, cooling requirements are sporadic. To meet them, it has been necessary to provide refrigeration or chiller equipment having a capacity substantially over average cooling requirements. Thus excess capital investment has been needed to meet peak load requirements. Second, power costs fluctuate with general demand and cooling requirements ordinarily parallel that demand. As a consequence, maximum rates are generally paid for power utilized in cooling.

The present invention seeks to overcome these prior art problems through an integrated system involving build-up of an efficient, reserve cooling capacity. This capacity may be generated during low-load periods of time at which power costs are minimal. Through this system, smaller and less costly refrigeration equipment can also be employed to meet even peak cooling load requirements.

These objectives may be achieved utilizing equipment primarily derived from conventional cooling systems. Such systems normally include three zones. These are: a cooling zone; a refrigeration zone; and a heat collection (or dissipation) zone.

The cooling zone is normally essentially co-extensive with the boundaries of the enclosure to be cooled. Thus, for example, in an office building, it would generally encompass the entire work space.

This zone should contain a conduit (or conduits) for conveying a cooling fluid and means for propelling the fluid through the conduit(s) to where the load occurs. Many such embodiments are readily apparent. Most buildings, for example, utilize forced air blown through conduits into individual rooms. In other situations, such as a freezer, recirculating fluids may be pumped through walls, or pipes in walls, surrounding the materials to be cooled. All these forms are compatible with the present invention.

The heat collection or dissipation zone is normally quite separate from the cooling zone. It is utilized to remove energy extracted from refrigerant by the chiller means in the refrigeration zone. All that is required for this zone is a collection means, many of which are again conventional. They may, for example, simply constitute an air cooled condenser, a standard building cooling tower or other heat rejection devices. For conservation of energy, it is preferred that the zone be one which transfers the energy to another use. Thus it may include a commercial converter means utilized for concentrating energy and producing, for example, hot water for the building.

Between the heat collection (or dissipation) means and the cooling zone is the refrigeration zone. In overall perspective, it functions to extract energy from the cooling fluid while exhausting energy to the collection means. The present refrigeration zone, like many conventional ones, should contain a closed refrigeration circuit, means for circulating refrigerant therein and chiller means within the circuit for removal of energy from the refrigerant.

In addition, the refrigeration zone of this invention contains a storage reservoir within the circuit. This reservoir is desirably large enough to hold a substantial amount ice/water mixture, preferably over 50% of the average daily cooling zone requirements and most preferably over 70%. The reservoir is generally thermally insulated and, in the case of use for air-conditioning buildings or the like where it may be very large and heavy, is located securely, as in the basement.

In accordance with the present invention, the refrigerant is unusual. It is composed of a slurry of ice and water. Where desired, it may additionally contain a freezing point depressant such as glycol (generally from about 5 to 25% by volume), salt (such as NaCl, $CaCl_2$, KF or $Na_2SO_4$) or the like. This permits the refrigerant to remain fluid at lower temperatures and so increases the cooling capacity of the system.

The refrigeration zone may actually be composed of two or more sub-circuits. Most efficient operation results where there is a sub-circuit including the chiller means and another connectable to the cooling zone. These sub-circuits must overlap partially and most commonly through mutual access to the storage reservoir, or reservoirs, should more than one be desired. Slurry may be shifted therebetween by conventional valves, pumps and conduits.

When in the storage phase of operation, a reserve cooling capacity is generated in this zone both by reducing the temperature of the refrigerant and by freezing water to ice. This is accomplished by passing the refrigerant through the chiller means as often as necessary. The slurry may then be recycled to the storage reservoir where, preferably while being maintained in motion by, for example, pumping it through small piping or by mechanical agitation, substantial pockets of complete solidification are avoided.

The amount of ice in the storage reservoir varies cyclically. During the storage phase where more and more water is frozen by passing slurry through the chiller, however, it approaches 70% by volume of the slurry. It may at other times fall to none, although normally the amount ranges between 10 and 70%, preferably 20 to 70%.

This storage phase of operation is performed primarily at times of minimim load requirement and lowest power cost. Both times generally coincide with night or other non-work periods. As a result, there is ample opportunity in which slowly to store a reserve cooling capacity (thereby reducing the capacity requirement for the chiller means) while saving on power.

When load requirements increase—normally during day time and working hours—and operation shifts to the cooling phase, it may not even be necessary to power the chiller means. Except under a very high load, there will be sufficient capacity stored to provide cooling throughout the day. This is not to say, however, that the chiller cannot be operated to yield auxillary cooling during peak load periods in conjunction with reliance upon the stored capacity.

During the cooling phase, the slurry is cycled to permit connection with the cooling zone. This is easily accomplished by simultaneously passing the cooling fluid and water from the slurry through, for example, a conventional heat exchanger means. There, an additional facet of the present invention becomes apparent. Because of the presence of ice in the slurry, the refrigerant itself possesses an especially high latent cooling capacity and can relay that reserve indirectly to the cooling fluid.

The novel features of the invention, as well as additional objects and advantages thereof, will be understood more fully from the following description when read in conjunction with the accompaning drawing.

DESCRIPTION OF THE DRAWING

The FIGURE is a diagrammatic view of the cooling system of the present invention.

In the FIGURE, the three primary zones of the system are depicted by dashed boxes. They are the cooling zone 1, the refrigeration zone 11, and the energy collection zone 12. The cooling and refrigeration zones 1 and 11 are shown operationally connectable through heat exchanger means 2. Collection means 30 of zone 12 is directly affixed to the chiller means 28 of refrigeration zone 11.

Most central to the present invention is the refrigeration zone 11. In its cooling phase of operation, the refrigerant slurry exits the storage reservoir 13 by pipe 14 through a control valve 15 and pipe 16 containing slurry pump 17. The slurry then passes through control valve 18 from which it is directed via pipe 19 into heat exchanger 2 which connects this sub-circuit of zone 11 with cooling zone 1.

The return refrigerant continues through pipe 19 from heat exchanger 2 to variable control valve 20. Most simply, all the slurry is then directed from control valve 20 via pipe 21 through valve 22 and back into the storage reservoir 13 by means of pipe 23. This completes the cooling phase sub-circuit because, as depicted, reservoir 13 constitutes a simple insulated holding tank, throughout which the slurry is freely mobile.

Also shown in storage reservoir 13 is an agitator means 25. This agitator ensures against build-up of large, inert chunks of ice in the slurry or on the walls of the reservoir. Such a build-up would raise difficulties in transfer of refrigerant through the pipes of the zone. Other means of performing this function are, however, possible.

In the above-described refrigeration zone 11, there is also depicted pipe 26 connecting pipe 19 directly with pipe 16 via valves 20 and 15. Pipe 26 by-passes the reservoir 13 and may be utilized to moderate the total cooling system. Fluid returning from the cooling heat exchanger 2 via pipe 19 generally has a lower unit cooling capacity than fluid exiting directly from the reservoir 13. By means of variable control valve 20, some of the returning fluid may be reconveyed via pipe 26, to mix with fresh reservoir fluid in valve 20, for cycling to the heat exchanger 2 as already described or, as described below, to the refrigeration sub-circuit of refrigeration zone 11.

In the refrigeraton phase of operation, slurry or fluid may also exit the storage reservoir 13 via pipe 14, valve 15 and pipe 16. At control valve 18, it is directed into the second sub-circuit through pipe 27 to chiller 28 which is normally either a centrifugal or screw machine refrigeration compressor, condenser and chiller combination. There energy is removed from the slurry or fluid to reduce its temperature and/or produce ice. The chiller thus yields a slurry having an increased cooling capacity and which is returned to the reservoir 13 via pipe 29 and through control value 22 and then pipe 23.

To extract energy from the slurry the chiller 28 must be connected to a heat collection (or dissipation) means 30. As previously described, this means 30 may range broadly in construction from something as simple as ventilators exposed to the air to something as complicated as a standard building cooling tower, a conventional closed circuit industrial cooler, or a heat recycling system. For the purpose of this invention, only this means 30 is required for the collection zone 12 and it is necessary only that it permit the continued operation of the chiller 28.

Returning to operation of the system during the cooling phase, refrigerant fluid passing through heat exchanger means 2 operates to transfer energy from the separate cooling fluid of zone 1. That fluid, which may be water, air or any other conventional fluid is introduced into the heat exchanger 2 by an appropriate conduit 3. After being cooled to the desired temperature by indirect contact with refrigerant fluid, it exits exchanger means 2 through conduit 4 under a force provided by a pump (or blower depending on the fluid) 5. The cooled fluid is then passed via conduit 6 to any number of separate conduits (herein depicted are two, 7 and 7') which may separately administer corresponding loads 8 and 8' where cooling is desired.

Depending upon the fluid and cooling mode actually employed, fluid may be recycled after encountering the load (8 and 8') through feed return conduits 9 and 9' to a collector return conduit 10 and finally back to conduit 3. Representative of this mode, for example, would be use of a liquid coolant fluid such as water in closed, recirculation. As represented by the use of dotted lines, however, conduits 9, 9' and 10 are optional and may not be present for simple air-conditioning. There, the load represented by a given room to be cooled would generally be met by exhausting cool air into the room. New air would be simultaneously introduced through conduit 3 from a different source to replace it.

The present system has been described with particular attention to use as an air-conditioning system for office and other buildings. For this embodiment, it is anticipated that the refrigerant would desirably be a mixture of water and about 10% glycol which would begin primary crystalization at about −4° C., reaching a final saturation point in the reservoir of approximately 70% ice at −10° C. The cooling capacity of the fluid cycled for connection with the separate cooling zone could then be moderated through rates of flow, admixture with fluid from other parts of the closed refrigeration zone or combinations thereof.

The present system offers a particularly unique solution to prior art problems. Most especially it unites a highly effective energy storage capacity, including latent melt enthalpy reserves, with reduced equipment requirements which permit operation over extended periods of time when power expenses are at their minimum. This integrated combination of elements and their attendant advantages offers at least equivalent results for much less than was heretofore required.

While various preferred embodiments of this invention have been illustrated and described, it will be understood by those in the art that changes and modifications may be resorted to without departing from the spirit and scope thereof.

What is claimed is:

1. In a system for cooling an enclosure having a cooling load comprising:

(a) A cooling zone containing a conduit in said enclosure for cooling fluid, said conduit encountering said load, means in said conduit for propelling said cooling fluid through said conduit and cooling fluid within said conduit;

(b) A refrigeration zone containing a closed refrigeration circuit for refrigerant, chiller means in said circuit for extracting energy from said refrigerant, means in said circuit for circulating said refrigerant and refrigerant within said circuit; and (c) Collection means connected to said refrigerant zone for removing energy extracted by said chiller means;

said refrigeration and cooling zones being connectable by a exchanger means for transfering energy from said cooling fluid to said refrigerant;

the improvement wherein said refrigerant in said closed circuit comprises a slurry of ice and water subject to cyclic differentials in the amounts thereof and said circuit includes a reservoir for storage of said slurry.

2. The system of claim 1, wherein the refrigeration circuit is composed of two sub-circuits, the first said sub-circuit including the chiller means; the second said sub-circuit including the exchanger means.

3. The system of claim 2, wherein both of the two sub-circuits include the storage reservoir.

4. The system of claim 2, wherein the two sub-circuits are interconnected for simultaneous operation.

5. The system of claim 4, wherein the two sub-circuits are interconnected for direct transfer of refrigerant from one to the other, exterior of the storage reservoir.

6. The system of claim 2, wherein the conduit of the cooling zone is a closed recirculation conduit.

7. The system of claim 2, wherein the conduit of the cooling zone is an open, non-continuous conduit.

8. The system of claim 2, wherein the collection means dissipates energy to the environment.

9. The system of claim 2, wherein the collection means recycles energy for use.

10. The system of any one of claim 1 wherein the enclosure is a building and said system is an air-conditioning system.

* * * * *